US007416092B2

(12) United States Patent
Dubois et al.

(10) Patent No.: US 7,416,092 B2
(45) Date of Patent: Aug. 26, 2008

(54) STACKABLE TRANSPORT BOX

(75) Inventors: Jean-Marc Dubois, Bremgarten (CH); Marc Emmenegger, Bremgarten (CH); Boris Schab, Villigen (CH)

(73) Assignee: George Utz Holding AG, Bremgarten (CH)

( * ) Notice: Subject to any disclaimer, the term of this patent is extended or adjusted under 35 U.S.C. 154(b) by 429 days.

(21) Appl. No.: 10/821,218

(22) Filed: Apr. 8, 2004

(65) Prior Publication Data

US 2004/0200833 A1 Oct. 14, 2004

(30) Foreign Application Priority Data

Apr. 9, 2003 (CH) ..... 0660/03

(51) Int. Cl.
*B65D 6/00* (2006.01)
*B65D 8/14* (2006.01)

(52) U.S. Cl. ..... 220/6; 206/511

(58) Field of Classification Search ..... 220/4.28, 220/6, 7, 668; 206/511
See application file for complete search history.

(56) References Cited

U.S. PATENT DOCUMENTS 2,070,070 A * 2/1937 Stoner ..... 220/6
4,674,647 A 6/1987 Gyenge et al.
4,775,068 A * 10/1988 Reiland et al. ..... 220/6
4,923,079 A * 5/1990 Foy ..... 220/7
5,467,885 A * 11/1995 Blinstrub ..... 220/6
5,586,675 A * 12/1996 Borsboom et al. ..... 220/6
5,788,103 A * 8/1998 Wagner et al. ..... 220/6
6,955,273 B2 * 10/2005 Hartwall ..... 220/1.6
2002/0070215 A1 * 6/2002 Walsh et al. ..... 220/6

FOREIGN PATENT DOCUMENTS

EP 0 697 341 A1 2/1996
EP 0 876 964 A1 11/1998
WO WO 03/008282 A1 1/2003

* cited by examiner

*Primary Examiner*—Anthony D Stashick
*Assistant Examiner*—Harry A Grosso
(74) *Attorney, Agent, or Firm*—Speckman Law Group PLLC; Victor N. King

(57) ABSTRACT

The present invention relates to a stackable and collapsible transport box. The transport box comprises a base plate, two shorter side walls which are mutually opposite and collapsible in a lower first plane connected to the base plate via hinge joints and two shorter side walls which are mutually opposite and collapsible in a higher second plane, also connected to the base plate via hinge joints. The base plate comprises a plurality of supporting pillars arranged as tube elements beneath the base plate and arranged as angle elements above the base plate. The angle elements are provided with step-like arrangements so that the angle elements may receive tube elements of another similar or identical transport box in the collapsed state.

13 Claims, 4 Drawing Sheets

STACKABLE TRANSPORT BOX

FIELD OF THE INVENTION

The present invention relates generally to a plastic stackable transport box.

BACKGROUND OF THE INVENTION

EP-A-0 876 963 describes a stackable and collapsible transport box wherein the side walls can be flipped inwardly about flexible pivots. A rotatable flap, which is rotatable about a horizontal axle, is provided in one of the side walls. The rotatable flap is rotatably connected to the side wall via an insert part which is fastened to a respective indent in the side wall. The floor of the transport box is connected at its corners and in the middle region to vertical supporting pillars which are fastened to a quadrangle supporting frame. The supporting frame has an integral configuration and a massive design.

To ensure that the supporting frame is sufficiently and mechanically stable and that it is able to reliably withstand loads in excess of 1000 kg, the supporting frame needs to have a certain thickness and width. For a transport box having the dimensions of more than 1 meter by 1 meter, the production of such a stable supporting frame will require especially large matrixes. Moreover, such a supporting frame needs to be welded to the supporting pillars or glued to the pillars using an artificial resin glue of very high strength.

Another stackable and collapsible transport box is described in U.S. Pat. No. 4,674,647. This transport box is provided with a pallet-type floor part, two mutually opposite side walls each having a lower hinge, and two other side walls each having a higher hinge. The height of the two side walls having the higher hinges is half the width of the floor part, so that the side walls may lie next to one another in the collapsed state. The maximum height of this transport box is thus limited to half the width of the floor part. Accordingly, this type of transport box can not be efficiently stacked on top of one another.

It is therefore the object of the present invention to provide a stackable and collapsible transport box which is capable of, in the collapsed state, carrying a similarly erected transport box having a load of 1000 kg and more.

SUMMARY OF THE INVENTION

The stackable and collapsible transport box of the present invention comprises a base plate and four side walls connected to the base plate via hinge joints. Two mutually opposite side walls are collapsible in a lower first plane and the two other side walls which are also mutually opposite, are collapsible in a higher second plane. The base plate comprises a plurality of supporting pillars preferably located in corner regions of the base plate that are arranged as tube elements beneath the base plate and arranged as angle elements above the base plate. The angle elements are provided with step-like arrangements which may receive tube elements of another similar or identical transport box in the collapsed state. Each of the angle elements preferably comprises a short section and a long section. The two side walls collapsible in a higher plane each comprise a rectangular cut-out in the two corner regions which fit the long section of the angle elements. These two side walls may be provided with at least two inwardly bent edges having an upwardly tapered bevel so that the side walls may be placed above one another. Each of the edges may be provided with a bevel which may be reinforced with several superimposed transversal ribs. In addition, each of the side walls may be provided with longitudinal and transverse ribs in at least the corner regions and in the extension of the angle elements so that the transport box may have a carrying capacity of approximately 1000 kg. The transverse and longitudinal ribs may be welded to a stiffening flat cover so that the transport box may have a carrying capacity of approximately 4500 kg.

The transport box may also be provided with a plurality of runner elements. The runner elements are provided with projecting cams that are fastened to the tube elements of the supporting pillars. These runner elements may be identical or diametrically opposed so that they may form a quadrangle which corresponds to the transport box when the runner elements are inserted in the tube elements. Each of the runner elements and the cams is provided with a hollow arrangement and each of the cams comprises reinforcing elements. Furthermore, each of the runner elements may be provided with a flat groove and may be connected via connecting elements.

The transport box may be manufactured by an injection-molding process using high-quality and impact-proof plastic such as polyethylene (PE) and polypropylene (PP).

The stackable and collapsed transport box of the present invention has the advantage in that transport boxes carrying heavy loads may be stacked randomly with other collapsible transport boxes. This advantage provides completely new possibilities in storage logistics, since empty collapsed transport boxes of the present invention no longer need to be collected and transported separately.

BRIEF DESCRIPTIONS OF THE DRAWINGS

Further advantages and embodiments of the present invention are explained in the following description with reference to the attached drawings, wherein.

DETAILED DESCRIPTION OF THE INVENTION

Figure 1:
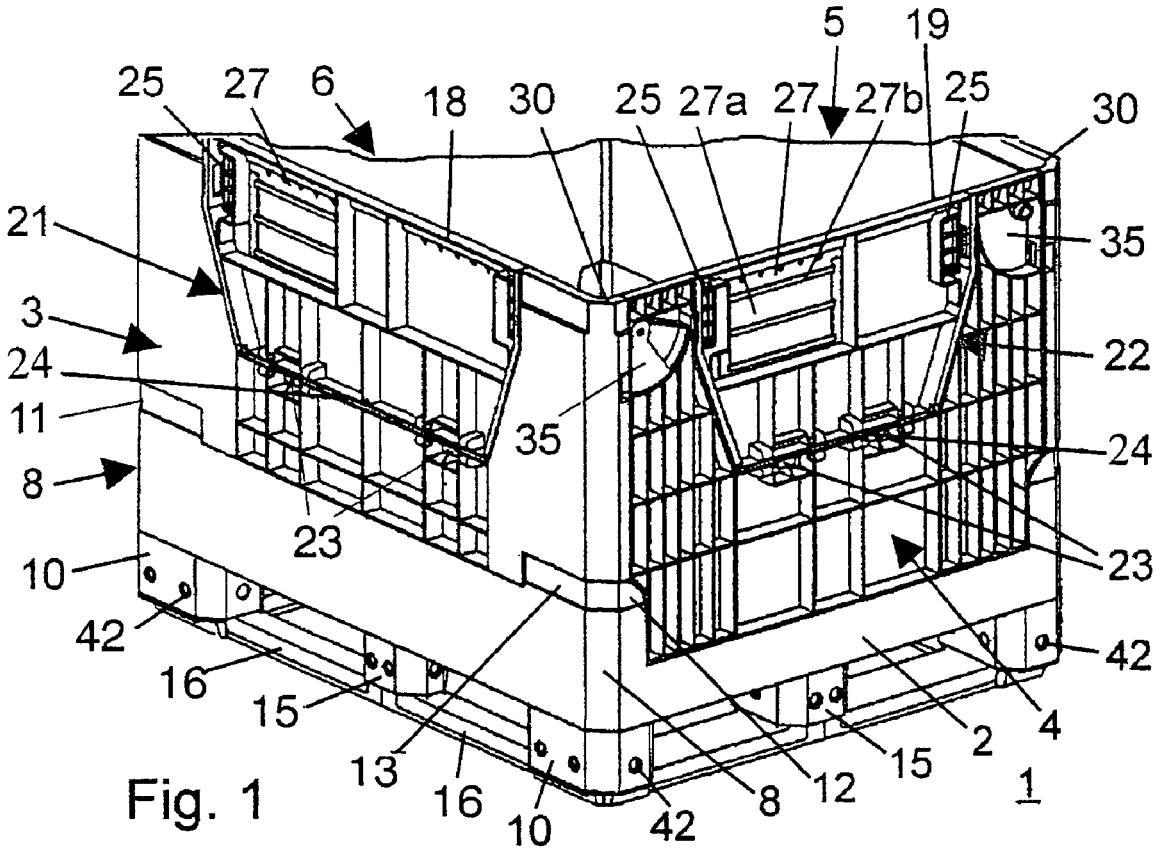
FIG. 1 shows a top perspective and partially sectional view of an embodiment of a stackable and collapsible transport box of the present invention.
Figure 2:
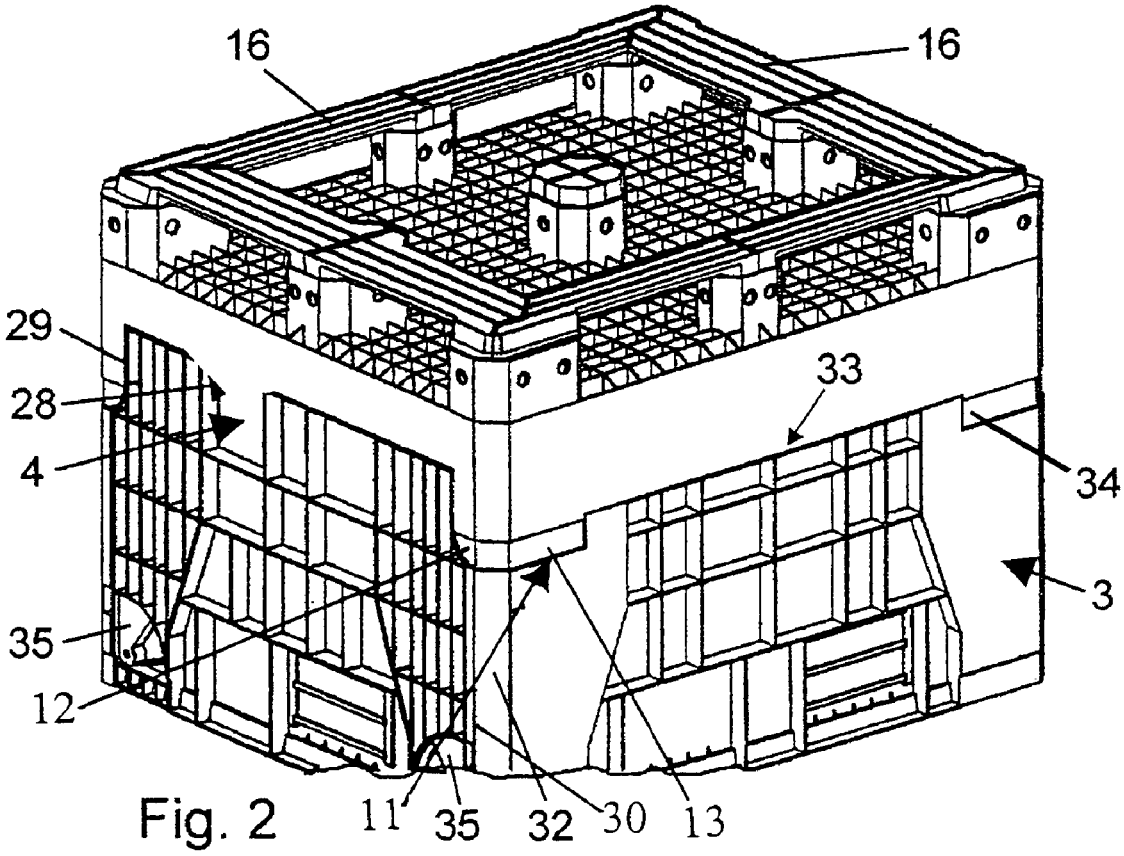
FIG. 2 shows a bottom perspective and partially sectional view of the stackable and collapsible transport box of FIG. 1.

FIGS. 1 and 2 show an embodiment of a stackable and collapsible transport box 1. In this embodiment, the transport box 1 is provided with a pallet-like base plate 2, two longer and mutually opposite side walls 3 and 5, and two shorter and mutually opposite side walls 4 and 6. The corners of base plate 2 are provided with corner supporting pillars 8. The corner supporting pillars 8 consist of a tube element 10 below base plate 2 and an angle element 11 above base plate 2. The tube element 10 has a cross section in the form of an oblong hexagon. The angle element 11 comprises a short section 12 and a long section 13. Central supporting pillars 15, arranged as tube elements, are provided between the corner supporting pillars 8. The central supporting pillars 15 have a hexagonal cross section. The corner supporting pillars 8 and central supporting pillars 15 are mutually connected via runner elements 16. The assembled runner elements 16 form a closed rectangle. The adjacent side walls 3 and 4 are each provided with a removal flap 18 and 19, respectively. The removal flaps 18, 19 are substantially trapezoid shaped. A respective cut-out 21, 22 is provided in each adjacent side walls 3, 4, into which the removal flaps 18, 19 fit in a flush manner.

As shown in FIG. 1 , the removal flaps 18, 19 are rotatably fastened to the lower edges 24 of the cut-outs 21, 22 via two hinge elements 23. Locking bars 25 are provided on both sides of the removable flaps 18, 19 so that the removable flaps 18, 19 may be locked and fastened to the side walls 3, 4. Label holders 27, each having a cassette 27*a* and a holding grate 27*b*, are provided on the removal flaps 18, 19. The holding grate 27*b* may be depressed into the lateral grooves of the cassette 27*a*. Thus, a label may be sufficiently tightly clamped to the label holder 27 so that the label cannot fall out.

The shorter side wall 4, shown in FIG. 2, may be flipped inwardly by means of a joint connection or a hinge 28. This side wall 4 is provided with a rectangular cut-out 29, which matches the shorter section 12 of the angle element 11. The longer side wall 3 is provided with two upright and inwardly bent edges 30. These edges 30 are provided with a bevel 32 which slightly tapers upwardly. The longer side wall 3 may also be flipped inwardly by means of a joint or a hinge 33. As shown in FIG. 2, the plane of the hinge joint 33 is higher than the plane of the hinge joint 28 50 that, in the collapsed state, the shorter side walls 4, 6 may lie beneath the longer side walls 3, 5. The longer side walls 3, 5 are also provided with rectangular cut-outs 34, matching the long section 13 of the angle element 11. Turn-lock fasteners 35 are provided in the shorter side walls 4, 6, which may be used to fasten side walls 4 and 6 to side walls 3 and 5.

Figure 3:
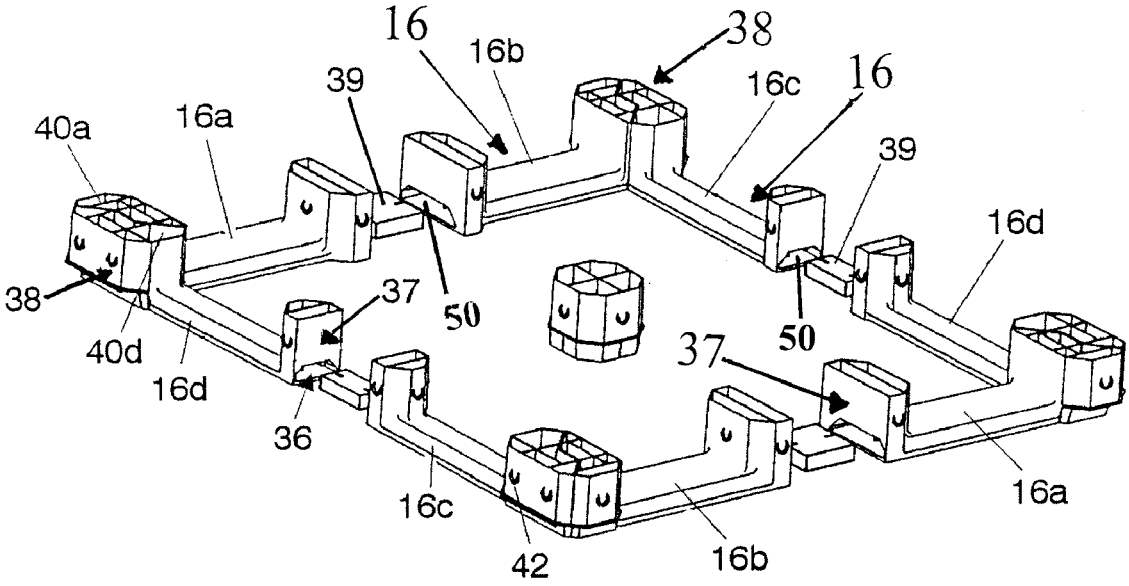
FIG. 3 shows a bottom perspective view of runner elements provided on the transport box of FIG. 1.
Figure 4:
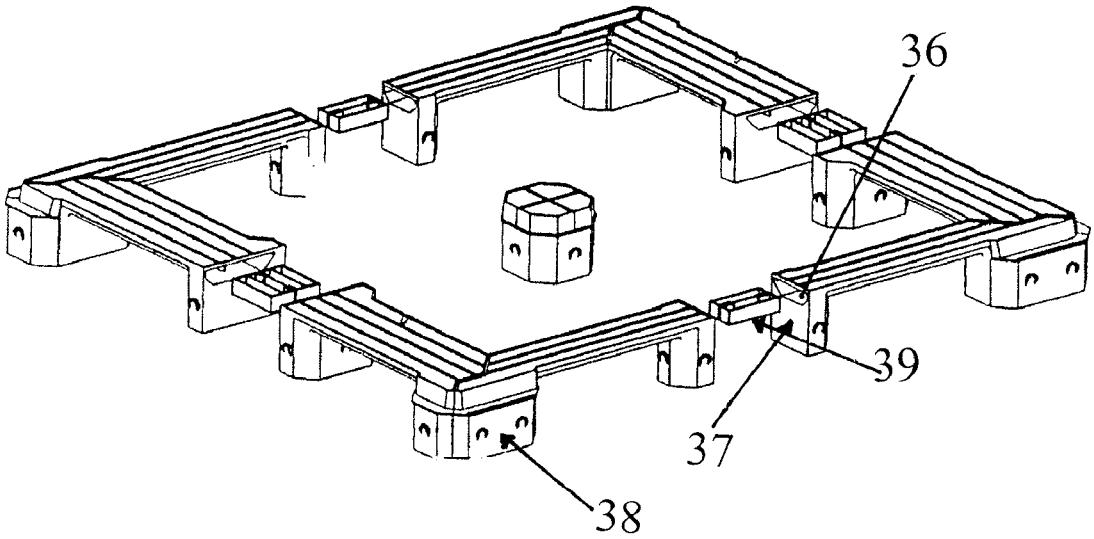
FIG. 4 shows a top perspective view of the runner elements of FIG. 3.

As shown in FIGS. 3 and 4, runner elements 16 are provided for the transport box. The runner elements may be arranged either as a short element 16*a* and a diametrically opposed short element 16*b*, or as a long element 16*c* and a diametrically opposed long element 16*d*. Each runner element 16 is provided with an oblong, hollow supporting part 36, an inner cam 37, and an outer cam 38. The runner elements 16 may be mutually connected via a connection element 39 by inserting the connection element 39 into the cavities or flat grooves 50 of the supporting parts 36. The two outer cams 38 of the short element 16*a* and the long element 16*d* are shaped in a diametrically opposed way and are each provided with a notched separating wall 40*a*, 40*d*. These two separating walls 40*a* and 40*d* thus fit into each other so that the two outer cams 38 may fit into the tube element 10 of the corner supporting pillar 8. The inner cams 37 of the short element 16*a* and the diametrically opposed short element 16*b* are also provided with a diametrically opposed configuration so that they fit precisely into the central supporting pillar 15, which is arranged as a tube element. Thus, a closed rectangular supporting frame may be formed. The inner cams 37 and outer cams 38 may be fastened, via screws (not shown in the figures) through bores 42 provided in the cams 37, 38, to the corner and central supporting pillars 8, 15 of the transport box 1.

Figure 5:
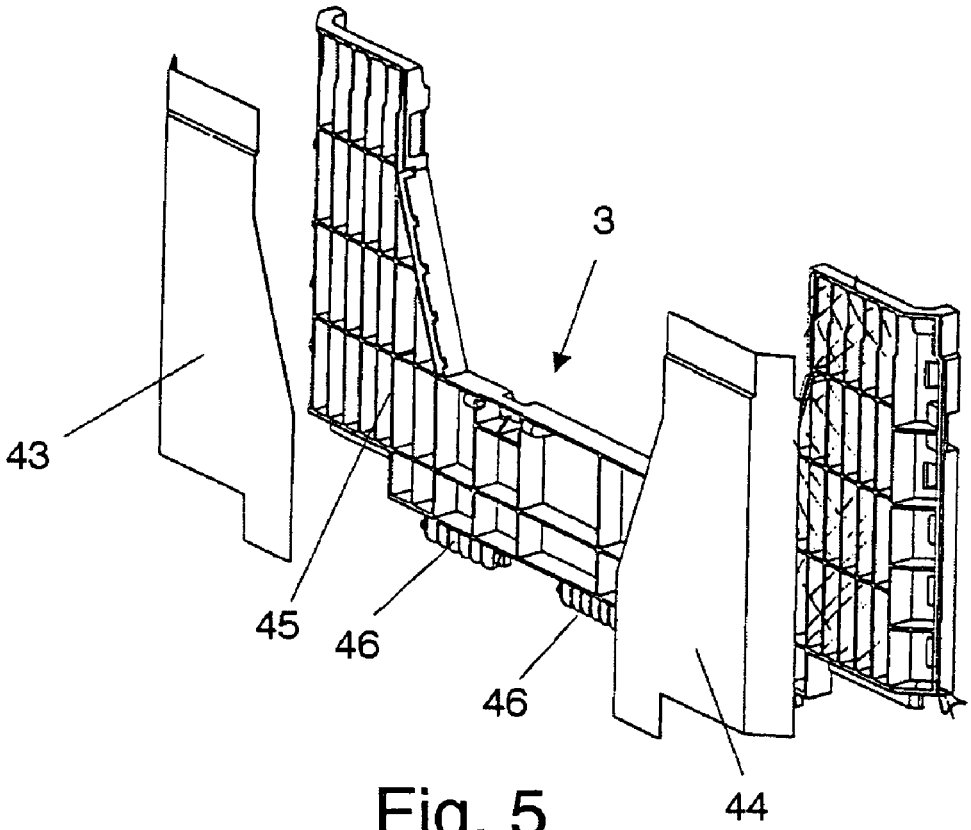
FIG. 5 shows a front perspective view of a side wall of the transport box of FIG. 1.
Figure 6:
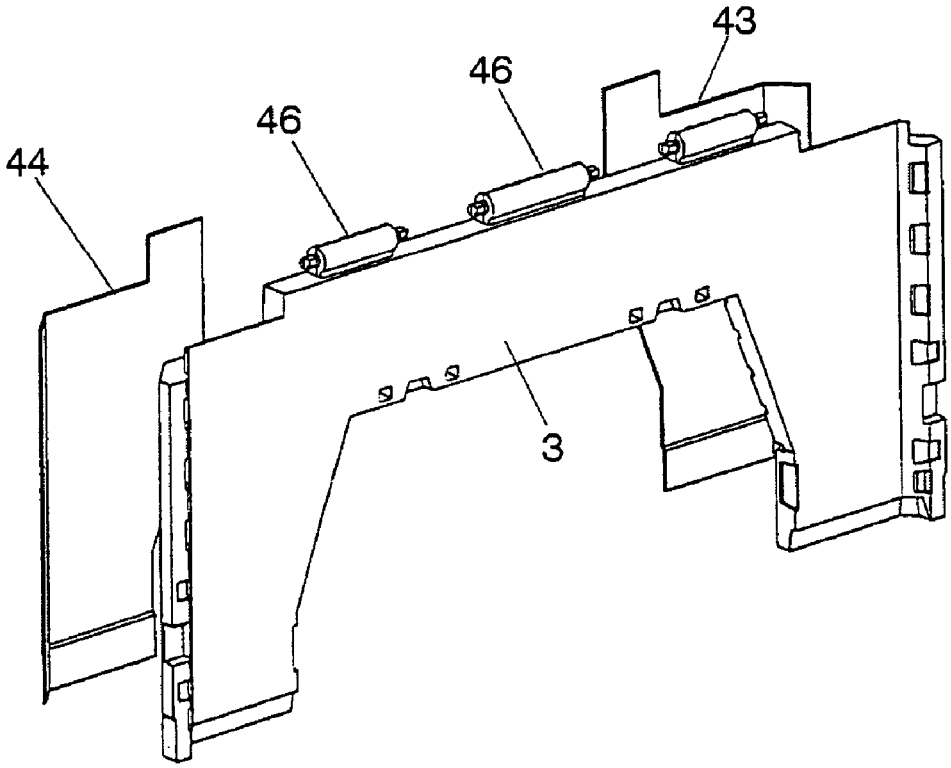
FIG. 6 shows a back perspective view of the side wall of FIG. 5.

FIGS. 5 and 6 show the side wall 3 which is provided with flat covers 43, 44. Side wall 3 is also provided with reinforcing ribs 45 and three hinges 46 which are located at the bottom of the side wall 3. The three hinges 46 may engage in respective hinge parts (not shown in the figures) provided in the base plate 2. The side wall 3 is held erect by the turn-lock fasteners 35 (see FIG. 1), and the side wall 3 may be flipped inwardly via hinge 33 when the turn-lock fasteners 35 are released.

Figure 7:
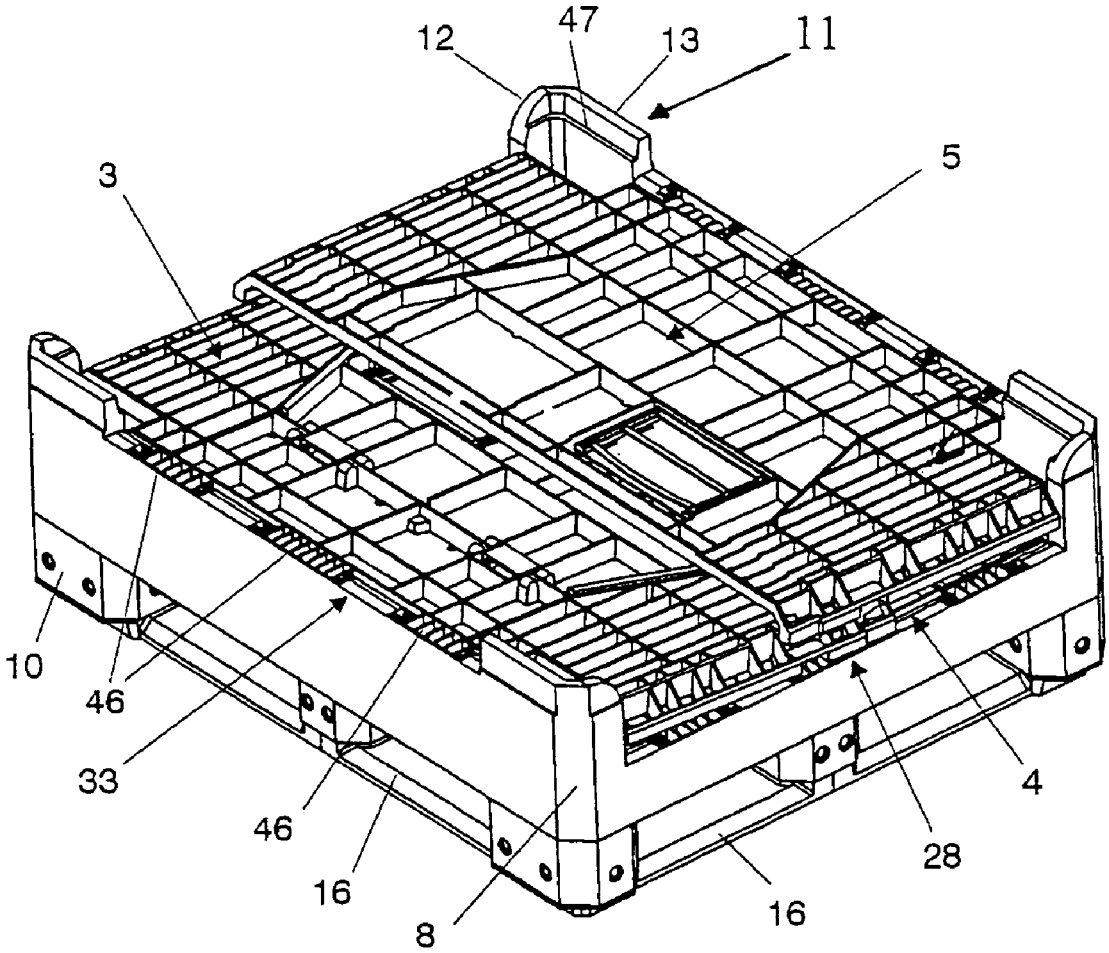
FIG. 7 shows a top perspective view of another embodiment of a transport box in the collapsed state.

FIG. 7 shows another embodiment of the transport box 1 in the collapsed state. In this embodiment, the shorter side walls 4, 6 of the transport box 1 in the collapsed state have been first placed on top of each other, and then the longer side walls 3 and 5 have been placed on top of the shorter side walls 4, 6. Since the longer side walls 3 and 5 are configured identically, the sequence with which they are placed on top of each other is irrelevant. As shown in FIG. 7, the angle elements 11 are each provided with an inner step 47 so that they may receive the runner elements 16 of another similar transport box. Thus, transport boxes 1 in both the collapsed state and erect state may be stacked in any desired sequence.

Figure 8:
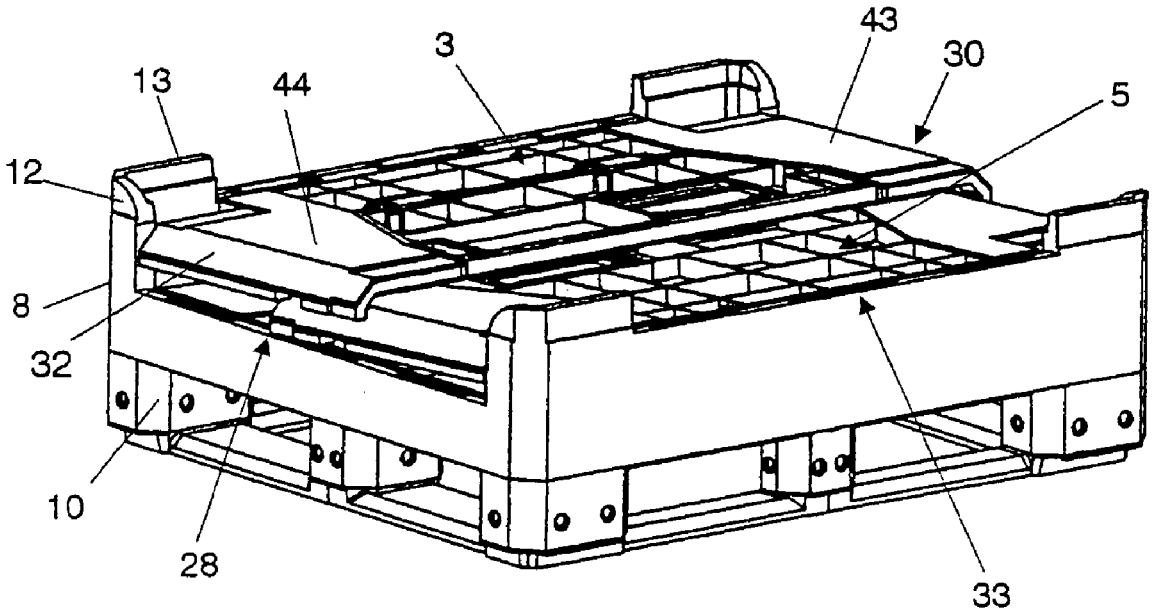
FIG. 8 shows side perspective view of the transport box of FIG. 7 in the collapsed state.

FIG. 8 shows the transport box 1 of FIG. 7, in which the side walls 3, 5 are provided with flat covers 43, 44. Since the transport box 1 has less stiffness against torsion, the carrying capacity of side walls 3 and 5 is lower than the embodiment shown in FIG. 1. In particular, the carrying capacity of the transport box 1 is up to approximately 1000 kg. The weight of a similar transport box (not shown) stacked on the transport box 1 is transmitted from the region of the edges 30 to the corner supporting pillars 8.

The transport box 1 may be manufactured by an injection-molding process using high-quality and impact-proof plastic such as polyethylene (PE) and polypropylene (PP). The base of transport box 1 is preferably 120 cm by 100 cm and preferably has a height in the non-collapsed state of 90 cm. In the collapsed state, the height is preferably approximately 40 cm. The weight of the transport box 1 is preferably approximately 50 kg.

We claim:

1. A stackable and collapsible transport box, comprising:

(a) a base plate;

(b) two first side walls which are mutually opposite and collapsible in a lower first plane connected to the base plate via hinge joints; and (c) two second side walls which are mutually opposite and collapsible in a higher second plane connected to the base plate via hinge joints, wherein the base plate comprises a plurality of supporting pillars, wherein the supporting pillar are arranged as tube elements beneath the base plate and arranged as L-shaped angle elements above the base plate, and wherein the L-shaped angle elements are provided with an inner step adapted to receive tube elements of a second transport box stacked on said transport box in the collapsed state.

2. The transport box according to claim 1, wherein the L-shaped angle elements each comprise a short section and a long section.

3. The transport box according to claim 2, wherein the two second side walls each comprise a rectangular cut-out in two corner regions which receive the long section of the L-shaped angle elements.

4. The transport box according to claim 1, wherein each of the second side walls is provided with at least two inwardly bent edges, wherein each edge is provided with a bevel which slightly tapers upwardly, and wherein the second side walls are configured identically, whereby the side walls are placeable in any sequence on top of each other.

5. The transport box according to claim 4, wherein the bevel is reinforced with a plurality of superimposed transversal ribs.

6. The transport box according to claim 1, wherein each of the first and second side walls comprises longitudinal and transverse ribs in the corner regions.

7. The transport box according to claim 6, wherein the transverse and longitudinal ribs are welded to a stiffening flat cover.

8. The transport box according to claim 1, wherein the transport box further comprises a plurality of runners provided with projecting cams which are fastened to the tube elements of the supporting pillars.

9. The transport box according to claim 8, wherein the runners comprise runner elements which form a quadrangle that corresponds to the transport box when the runner elements are inserted in the tube elements.

10. The transport box according to claim 8, wherein each of the runner elements and the cams is provided with a hollow arrangement and each of the cams comprises reinforcing elements.

11. The transport box according to claim 9, wherein each of the runner elements is provided with a flat groove and may be assembled into a quadrangle via connecting elements.

12. The transport box according to claim 1, wherein the transport box may be manufactured by an injection-molding process using plastic.

13. The transport box according to claim 12, wherein the plastic is selected from the group consisting of: polyethylene (PE) and polypropylene (PP).

* * * * *